US009938598B2

(12) United States Patent
Hatano et al.

(10) Patent No.: US 9,938,598 B2
(45) **Date of Patent: *Apr. 10, 2018**

(54) HIGH-PURITY FERRITIC STAINLESS STEEL SHEET WITH EXCELLENT OXIDATION RESISTANCE AND HIGH-TEMPERATURE STRENGTH, AND PROCESS FOR PRODUCING THE SAME

(75) Inventors: Masaharu Hatano, Tokyo (JP); Eiichiro Ishimaru, Tokyo (JP); Akihiko Takahashi, Tokyo (JP)

(73) Assignee: NIPPON STEEL & SUMIKIN STAINLESS STEEL CORPORATION, Tokyo (JP)

( * ) Notice: Subject to any disclaimer, the term of this patent is extended or adjusted under 35 U.S.C. 154(b) by 497 days.

This patent is subject to a terminal disclaimer.

(21) Appl. No.: 14/000,070

(22) PCT Filed: Jan. 23, 2012

(86) PCT No.: PCT/JP2012/051365

§ 371 (c)(1),
(2), (4) Date: Aug. 16, 2013

(87) PCT Pub. No.: WO2012/111391

PCT Pub. Date: Aug. 23, 2012

(65) Prior Publication Data

US 2013/0319583 A1 Dec. 5, 2013

(30) Foreign Application Priority Data

Feb. 17, 2011 (JP) ..... 2011-032476
Feb. 17, 2011 (JP) ..... 2011-032499

(51) Int. Cl.
*C21D 8/02* (2006.01)
*C22C 38/06* (2006.01)
(Continued)

(52) U.S. Cl.
CPC ..... *C21D 8/0263* (2013.01); *B21B 1/026* (2013.01); *C21D 6/002* (2013.01); *C21D 8/02* (2013.01);
(Continued)

(58) Field of Classification Search
CPC ..... B21B 1/026; C21D 6/002; C21D 8/02; C21D 8/0263; C21D 9/46; C22C 1/02;
(Continued)

(56) References Cited

U.S. PATENT DOCUMENTS 4,515,644 A * 5/1985 Sawatani ..... C21D 8/0405 148/608
4,581,066 A * 4/1986 Maruhashi ..... C22C 38/18 420/42
(Continued)

FOREIGN PATENT DOCUMENTS

EP 2 182 085 A1 5/2010
EP 2 246 455 A1 11/2010
(Continued)

OTHER PUBLICATIONS

JP 2009-215648 A was cited in Chinese Office Action dated Sep. 28, 2014.
(Continued)

*Primary Examiner* — Jenny R Wu
(74) *Attorney, Agent, or Firm* — Birch, Stewart, Kolasch & Birch, LLP

(57) ABSTRACT

The present invention provides a low-alloy high-purity ferritic stainless steel sheet provided with improved oxidation resistance and high-temperature strength by utilizing Sn addition in trace amounts without relying on excessive alloying of Al and Si which reduces fabricability and weldability or addition of rare elements such as Nb, Mo, W, and rare earths, and a process for producing the same. The
(Continued)

high-purity ferritic stainless steel sheet includes C: 0.001 to 0.03%, Si: 0.01 to 2%, Mn: 0.01 to 1.5%, P: 0.005 to 0.05%, S: 0.0001 to 0.01%, Cr: 16 to 30%, N: 0.001 to 0.03%, Al: 0.05 to 3%, and Sn: 0.01 to 1% (% by mass), with the remainder being Fe and unavoidable impurities. A stainless steel slab having such steel components is heated, wherein an extraction temperature is 1100 to 1250° C., and a winding temperature after hot rolling is 650° C. or lower. A hot-rolled sheet is annealed at 900 to 1050° C., and cooled at 10° C./sec or less over a temperature range of 550 to 850° C.

12 Claims, 1 Drawing Sheet

(51) Int. Cl.

| | |
|---|---|
| ***C22C 38/04*** | (2006.01) |
| ***C22C 38/02*** | (2006.01) |
| ***C22C 38/00*** | (2006.01) |
| ***B21B 1/02*** | (2006.01) |
| ***C22C 38/28*** | (2006.01) |
| ***C22C 38/30*** | (2006.01) |
| ***C22C 38/32*** | (2006.01) |
| ***C22C 38/26*** | (2006.01) |
| ***C21D 6/00*** | (2006.01) |
| ***C21D 9/46*** | (2006.01) |
| ***C22C 38/20*** | (2006.01) |
| ***C22C 38/22*** | (2006.01) |
| ***C22C 38/34*** | (2006.01) |
| ***C22C 38/40*** | (2006.01) |
| ***C22C 1/02*** | (2006.01) |

(52) U.S. Cl.
CPC ..... *C21D 9/46* (2013.01); *C22C 1/02* (2013.01); *C22C 38/001* (2013.01); *C22C 38/002* (2013.01); *C22C 38/004* (2013.01); *C22C 38/005* (2013.01); *C22C 38/008* (2013.01); *C22C 38/02* (2013.01); *C22C 38/04* (2013.01); *C22C 38/06* (2013.01); *C22C 38/20* (2013.01); *C22C 38/22* (2013.01); *C22C 38/26* (2013.01); *C22C 38/28* (2013.01); *C22C 38/30* (2013.01); *C22C 38/32* (2013.01); *C22C 38/34* (2013.01); *C22C 38/40* (2013.01)

(58) Field of Classification Search
CPC ... C22C 38/001; C22C 38/002; C22C 38/004; C22C 38/005; C22C 38/008; C22C 38/02; C22C 38/04; C22C 38/06; C22C 38/20
USPC ..... 148/325, 602; 420/34, 36, 40, 42, 60, 420/62, 63, 67, 70; 72/66
See application file for complete search history.

(56) References Cited

U.S. PATENT DOCUMENTS

| | | | | |
|---|---|---|---|---|
| 4,834,808 | A * | 5/1989 | Hill | C21D 8/0205 148/325 |
| 2010/0139818 | A1* | 6/2010 | Ishii | C21D 8/0205 148/603 |
| 2010/0150770 | A1* | 6/2010 | Hiraide | C22C 38/004 420/41 |
| 2011/0265920 | A1* | 11/2011 | Hatano | C21D 1/76 148/606 |

FOREIGN PATENT DOCUMENTS

| | | | | |
|---|---|---|---|---|
| EP | 2 548 988 | A1 | 1/2013 | |
| JP | 3-53026 | A | 3/1991 | |
| JP | 2000-169943 | A | 6/2000 | |
| JP | 2008-190003 | A | 8/2008 | |
| JP | 2008-261020 | A | 10/2008 | |
| JP | 2009-108364 | A | 5/2009 | |
| JP | 2009-167443 | A | 7/2009 | |
| JP | 2009-215648 | A | 9/2009 | |
| JP | 2010-31315 | A | 2/2010 | |
| JP | 2010-116619 | A | 5/2010 | |
| WO | WO 2007129703 | A1 * | 11/2007 | C22C 38/004 |
| WO | WO 2008156195 | A1 * | 12/2008 | C21D 8/0205 |
| WO | WO 2010067878 | A1 * | 6/2010 | C21D 1/76 |

OTHER PUBLICATIONS

International Search Report for PCT/JP2012/051365 dated Apr. 17, 2012.
Extended European Search Report dated Oct. 16, 2014, issued in corresponding European Patent Application No. 12747087.0.
English translation of Japanese Office Action dated Jan. 26, 2016, issued in counterpart Japanese Patent Application No. 2015-040564.
English translation of the Chinese Office Action and Search Report, dated Sep. 28, 2014, for Chinese Application No. 201280009213.X.
Hideo Ike et al.; The Oxidation Behavior of Fe—Cr-0.3% A1 Alloys at High Temperature; pp. 1120-1126; 1979.

* cited by examiner

HIGH-PURITY FERRITIC STAINLESS STEEL SHEET WITH EXCELLENT OXIDATION RESISTANCE AND HIGH-TEMPERATURE STRENGTH, AND PROCESS FOR PRODUCING THE SAME

TECHNICAL FIELD

The present invention relates to a low-alloy high-purity ferritic stainless steel sheet with excellent oxidation resistance and high-temperature strength in a high-temperature environment, for example, at 400° C. to 1050° C., and a process for producing the same. In particular, the present invention relates to a high-purity ferritic stainless steel with excellent oxidation resistance and high-temperature strength that is suitable as a constituent member of heaters, burning appliances, automotive exhaust systems, and the like.

BACKGROUND ART

Ferritic stainless steels have been used in a wide range of fields, for example, kitchen utensil, household electrical appliances, and electronic equipment. In recent years, extremely low carbon/nitrogen contents and reduction of impurity elements such as P and S have become possible by the improvement of refining technology, and ferritic stainless steels with corrosion resistance and workability improved by adding stabilizing elements such as Nb and Ti (hereinafter referred to as high-purity ferritic stainless steel) have been being used in a wide range of applications. This is because high-purity ferritic stainless steels are more excellent in economic efficiency than austenitic stainless steels containing large amounts of Ni, the price of which has recently soared.

Also in the field of heat-resistant steel that requires oxidation resistance and high-temperature strength, high-purity ferritic stainless steels such as SUS430J1L, SUS436J1L, and SUH21 are standardized (JIS G 4312). SUS430J1L, SUS436J1L, and SUH21, as represented respectively by 19Cr-0.5Nb, 18Cr-1Mo, and 18Cr-3Al, are characterized by addition of rare elements Nb and No or addition of large amounts of Al. Al-containing high-purity ferritic stainless steels represented by SUH21 have excellent oxidation resistance but have problems with workability, weldability, and fabricability associated with low toughness.

Various studies have hitherto been made on the problems of Al-containing high-purity ferrite mentioned above. For example, Patent Document 1 discloses an Al-containing heat-resistant ferritic stainless steel sheet with excellent workability and oxidation resistance including Cr: 13 to 20%, Al: 1.5 to less than 2.5%, Si: 0.3 to 0.8%, and Ti: 3×(C+N) to 20×(C+N), and a process for producing the same. Patent Document 2 discloses a ferritic stainless steel with excellent steam oxidation resistance and thermal fatigue properties including Cr: 8 to 25%, C: 0.03% or less, N: 0.03% or less, Si: 0.1 to 2.5%, Al: 4% or less, and A value, defined as A=Cr+5(Si+Al), in the range of 13 to 60. Such stainless steels disclosed in Patent Documents 1 and 2 are characterized by combined addition of Al and Si with the amount of Al being reduced. Such steels, however, still have a problem with fabricability because Si is an element that decreases steel toughness. Further, the stainless steel disclosed in Patent Document 3 contains Cr: 11 to 21%, Al: 0.01 to 0.1%, Si: 0.8 to 1.5%, Ti: 0.05 to 0.3%, Nb: 0.1 to 0.4%, C: 0.015% or less, and N: 0.015% or less, and 2% or less of W is added as required to obtain high-temperature strength. The stainless steels disclosed in these Patent Documents ensure oxidation resistance and high-temperature strength by reducing the Al content and adding Si or a rare element W.

One possible method for solving the problems described above is to improve oxidation resistance and high-temperature strength using trace elements without relying on high alloying. Conventionally, rare-earth elements are known as a trace element that dramatically improves oxidation resistance. For example, Patent Document 4 discloses adding one or more of rare-earth elements: 0.2% or less, Y: 0.5% or less, Hf: 0.5% or less, and Zr: 1% or less, with their total amount being 1% or less, to a ferritic stainless steel including Cr: 12 to 32% without relying on Si or Al. Further, for high-temperature strength, Patent Document 5 discloses a ferritic stainless steel with excellent high-temperature strength including trace elements Sn and Sb, and a process for producing the same. Most steels disclosed in Patent Document 5 are low-Cr steel including Cr: 10 to 12%, and in the case of high-Cr steel including Cr: more than 12%, V, Mo, and the like are added in combination in order to ensure high-temperature strength. Although the improvement in high-temperature strength is described as an effect of Sn and Sb, there is no discussion or description of the oxidation resistance aimed at by the present invention.

Inventors have hitherto disclosed high-purity ferritic stainless steels with corrosion resistance and workability improved by adding trace amounts of Sn without relying on high alloying of Cr or Mo from the standpoint of resource saving and economic efficiency. The stainless steels disclosed in Patent Documents 6 and 7 are a high-purity ferritic stainless steel including Cr: 13 to 22%; Sn: 0.001 to 1%; C, N, Si, Mn, and P: reduced amount; and Al: in the range of 0.005 to 0.05%; with stabilizing elements Ti and Nb being added as required.

These Patent Documents, however, have not discussed the influence of the addition of trace amounts of Sn and Al on the oxidation resistance and high-temperature strength aimed at by the present invention.

Further, Patent Document 8 discloses a ferritic stainless steel including Cr: 11 to 22%; Al: 1.0 to 6.0%; C, N, and S: reduced amount; and one or more elements selected from the group consisting of Sn: 0.001 to 1.0%, Nb: 0.001 to 0.70%, and V: 0.001 to 0.50% and discloses prevention of evaporation of Cr and/or compounds thereof in an environment where the ferritic stainless steel is exposed to water vapor at high temperature, but does not disclose the effect of addition of Al and Sn on oxidation resistance and high-temperature strength.

PRIOR ART DOCUMENTS

Patent Documents

Patent Document 1: Japanese Laid-open Patent Publication No. 2004-307918

Patent Document 2: Japanese Laid-open Patent Publication No. 2003-160844

Patent Document 3: Japanese Laid-open Patent Publication No. 08-260107

Patent Document 4: Japanese Laid-open Patent Publication No. 2004-39320

Patent Document 5: Japanese Laid-open Patent Publication No. 2000-169943

Patent Document 6: Japanese Laid-open Patent Publication No. 2009-174036

Patent Document 7: Japanese Laid-open Patent Publication No. 2010-159487

Patent Document 8: Japanese Laid-open Patent Publication No. 2009-167443

SUMMARY OF THE INVENTION

Problems to be Solved by the Invention

As mentioned above, addition of Al or combined addition of Al and Si is effective for ensuring the oxidation resistance and high-temperature strength of a high-purity ferritic stainless steel, but there are still problems with fabricability and weldability. Further, to ensure the properties described above without relying on high alloying of Al or Si, it is necessary to use very expensive rare elements such as Nb, Mo, W, and rare earths. On the other hand, a high-purity ferritic stainless steel to which Sn are added in trace amounts from the standpoint of resource saving and economic efficiency has been disclosed, but the high-purity ferritic stainless steel is not provided with oxidation resistance and high-temperature strength.

Thus, an object of the present invention is to provide a low-alloy high-purity ferritic stainless steel sheet with oxidation resistance and high-temperature strength improved by utilizing Sn addition without relying on excessive alloying of Al and Si which reduces fabricability and weldability or addition of rare elements such as Nb, Mo, W, and rare earths, and a process for producing the same.

Means for Solving the Problems

To solve the problems described above, the present inventors intensively studied on the effects of Sn addition and Al on oxidation resistance and high-temperature strength in high-purity ferritic stainless steel to make the following new findings, thereby completing the present invention.

(a) Sn is an element effective for the increase in high-temperature strength, and adding Sn reduces the addition of Nb, Mo, and W. It was found that the Cr content of 16% or more was effective for producing the effect of improving oxidation resistance as well as high-temperature strength by adding Sn. Although such an oxidation resistance-improving effect is still poorly understood, the present inventors have deduced its mechanism of action based on the experimental evidence mentioned below.

(b) 16Cr steel with Sn added (hereinafter referred to as Sn-added 16Cr steel) and heat-resistant stainless steels (19Cr-0.5Nb steel and 18Cr-1Mo steel) were subjected to a continuous oxidation test in air at 950° C. for 200 hr. In the 19Cr-0.5Nb steel and the 18Cr-1Mo steel, peel-off of an oxidized film started to proceed, whereas the Sn-added 16Cr steel exhibited high stability of a protective film without causing unusual oxidation or peel-off of an oxidized film.

(c) Detailed analysis of the oxidized film of the Sn-added 16Cr steel proved that Sn was not present in the oxidized film and the Cr concentration in the oxidized film were higher than those of the 19Cr-0.5Nb steel and the 18Cr-1Mo steel. In other words, Sn addition exhibited the effect of increasing the Cr concentration in a chromia film ($Cr_2O_3$) to prevent invasion of the oxidized film by Fe, Mn, Ti, and the like which leads to breakdown of $Cr_2O_3$. Due to such an effect of Sn addition, the oxidation resistance and high-temperature strength equal to or higher than those of the heat-resistant stainless steels described above (19Cr-0.5Nb steel and 18Cr-1Mo steel) can be achieved using low-alloy 16Cr steel.

(d) It was found that the oxidation resistance of the Sn-added 16Cr steel described above was stably exhibited by adding Al in an amount of 0.05% or more. When the Al content is 0.8% or less, although a continuous oxidized film of Al is not produced, reduced oxygen partial pressure at the steel interface is believed to contribute to the improvement in stability of $Cr_2O_3$. Although such an improvement in oxidation resistance due to Sn+Al is still poorly understood, it is believed that the effect of Sn addition is multiplied by trace amounts of Al. Further, when the amount of Al is more than 0.8%, production of a continuous oxidized film of Al proceeds, thereby producing an oxidation resistance-improving effect of an alumina film exceeding that of a chromia film. In other words, the oxidation resistance of the heat-resistant stainless steel (SUH21) described above can be achieved with less Cr content and Al content.

(e) For the improvement in oxidation resistance mentioned above, it is effective to reduce C, N, P, and S to thereby achieve high purification of the steel and add stabilizing elements such as Nb and Ti.

(f) In heating of cast billet during hot rolling, the extraction temperature after heating is a temperature at which the amount of scale deposition for removing scabs and inclusions on the cast billet surface, which inclusions degrade surface properties, is ensured; fine TICS is generated to reduce solid solution S which induces unusual oxidation; and generation of MnS and CaS which can be the origin of unusual oxidation is inhibited. In the case of a Sn-added steel with a Cr content of 16.0% or more, it is effective to set the extraction temperature at 1100 to 1200° C.

(g) Winding after hot rolling is carried out at a temperature which ensures steel toughness and prevents internal oxide and grain boundary oxidation which can cause degradation of surface properties. In the case of a Sn-added steel with a Cr content of 16.0% or more, it is effective to set the temperature at 500 to 600° C. Further, carrying out hot-rolled sheet annealing at 900° C. or higher to form a solid solution of stabilizing elements such as Nb and Ti and slowly cooling the annealed sheet at 10° C./sec or less over a temperature range of 550 to 850° C. is effective for enhancing high-temperature strength and oxidation resistance because reduction in grain boundary segregation of Sn and Cr and production of fine carbonitrides is promoted.

The gist of the present invention which has been accomplished based on the findings (a) to (g) above is as described below.

(1) A high-purity ferritic stainless steel sheet with excellent oxidation resistance and high-temperature strength, including C: 0.001 to 0.03%, Si: 0.01 to 2%, Mn: 0.01 to 1.5%, P: 0.005 to 0.05%, S: 0.0001 to 0.01%, Cr: 16 to 30%, N: 0.001 to 0.03%, Al: 0.05 to 3%, and Sn: 0.01 to 1% (% by mass), with the remainder being Fe and unavoidable impurities.

(2) The high-purity ferritic stainless steel sheet with excellent oxidation resistance and high-temperature strength according to (1) above, wherein the Al content in the steel sheet is more than 0.8% to 3%.

(3) The high-purity ferritic stainless steel sheet with excellent oxidation resistance and high-temperature strength according to (1) or (2) above, wherein the steel sheet further includes one or more of Nb: 0.5% or less, Ti: 0.5% or less, Ni: 0.5% or less, Cu: 0.5% or less, Mo: 0.5% or less, V: 0.5% or less, Zr: 0.5% or less, Co: 0.5% or less, Mg: 0.005% or less, B: 0.005% or less, and Ca: 0.005% or less (% by mass).

(4) The high-purity ferritic stainless steel sheet with excellent oxidation resistance and high-temperature strength according to any one of (1) to (3) above, wherein the steel sheet further includes one or more of Zr: 0.1% or less, La: 0.1% or less, Y: 0.1% or less, Hf: 0.1% or less, and REM: 0.1% or less (% by mass).

(5) A process for producing the high-purity ferritic stainless steel sheet with excellent oxidation resistance and high-temperature strength according to any one of (1) to (4) above, including heating a stainless steel slab having the steel components according to any one of (1) to (4) above, wherein an extraction temperature is 1100 to 1250° C., and a winding temperature after hot rolling is 600° C. or lower (6) A process for producing the high-purity ferritic stainless steel sheet with excellent oxidation resistance and high-temperature strength according to any one of (1) to (4) above, including annealing a hot-rolled steel sheet produced by the production process according to (4) above at 900 to 1050° C., the hot-rolled steel sheet having the steel components according to any one of (1) to (4) above, and then cooling the annealed steel sheet at 10° C./sec or less over a temperature range of 550 to 850° C.

Effects of the Invention

The present invention has such a pronounced effect that a low-alloy high-purity ferritic stainless steel sheet provided with improved oxidation resistance and high-temperature strength equal to or higher than those of existing heat-resistant steels by utilizing Sn addition can be obtained without relying on excessive alloying of Al and Si which reduces fabricability and weldability or addition of rare elements such as Nb, Mo, W, and rare earths.

BEST MODE FOR CARRYING OUT THE INVENTION

Figure 1:
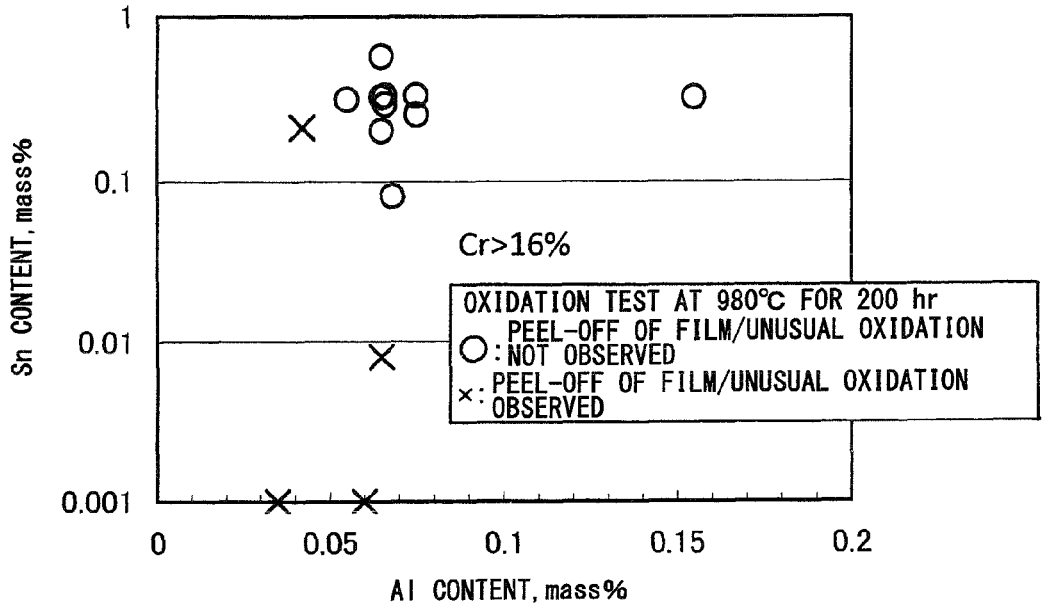
FIG. 1 illustrates the relationship between the contents of Cr, Sn, and Al and oxidation resistance of the stainless steel sheet of Example 1.

The requirements of the present invention will now be described in detail. It should be understood that "%" representation of the content of each element means "% by mass".

(I) First, limitations on the components of the steel sheet will now be described.

C deteriorates oxidation resistance, and its content is preferably as small as possible; thus, the upper limit is 0.03%. However, excessive reduction leads to increased refining cost; thus, the lower limit is 0.001%. Preferably, in view of oxidation resistance and production cost, the C content is 0.002 to 0.01%.

Si is not only effective as a deoxidizing element but also an element that improves oxidation resistance. To ensure the effect of a deoxidizer and the oxidation resistance of the present invention, the lower limit is 0.01%.

However, excessive addition causes reduction in steel toughness and workability; thus, the upper limit is 2%. Preferably, in view of effectiveness and fabricability, the Si content is in the range of 0.05 to 1%, and more preferably 0.1 to 0.6%.

Mn is an element that reduces oxidation resistance, and its content is preferably as small as possible. From the standpoint of preventing the reduction in oxidation resistance, the upper limit is 1.5%. However, excessive reduction leads to increased refining cost; thus, the lower limit is 0.01%. Preferably, in view of oxidation resistance and production cost, the Mn content is 0.05 to 0.5%.

P is an element that reduces fabricability and weldability, and its content is preferably as small as possible. From the standpoint of preventing the reduction in fabricability and weldability, the upper limit is 0.05%. However, excessive reduction leads to increased refining cost; thus, the lower limit is 0.005%. Preferably, in view of production cost, the P content is 0.01 to 0.04%.

S deteriorates oxidation resistance and hot workability, and its content is preferably as small as possible. Thus, the upper limit is 0.01%. However, excessive reduction leads to increased refining cost; thus, the lower limit is 0.0001. Preferably, in view of oxidation resistance and production cost, the S content is 0.0002 to 0.002%.

Cr is a fundamental constituent element of the high-purity ferritic stainless steel of the present invention, and is an element essential to ensure the oxidation resistance and high-temperature strength, which are aimed at by the present invention, by adding Sn. To ensure the oxidation resistance and high-temperature strength of the present invention, the lower limit is 16.0%. The upper limit, from the standpoint of fabricability, is 30%. However, in terms of economic efficiency as compared to SUH21, the Cr content is preferably 16.0 to 22.0%. In view of performance and alloy cost, it is more preferably 16.0 to 18.0%.

N deteriorates oxidation resistance similarly to C, and its content is preferably as small as possible; thus, the upper limit is 0.03%. However, excessive reduction leads to increased refining cost; thus, the lower limit is 0.001%. Preferably, in view of oxidation resistance and production cost, the N content is 0.005 to 0.015%.

Al is not only an element effective as a deoxidizing element, but also an element essential to enhance the oxidation resistance aimed at by the present invention. The lower limit is not less than 0.05% in order to produce an oxidation resistance-improving effect in combination with Sn addition, and preferably more than 0.8%. The upper limit is 3.0% from the standpoint of fabricability. However, excessive addition causes deterioration in steel toughness and weldability; thus, the Al content is preferably more than 0.8% to 2.0%. In terms of economic efficiency as compared to SUH21, it is more preferably 1.0 to 2.0%.

Sn is an element essential to ensure the oxidation resistance and high-temperature strength, which are aimed at by the present invention, without relying on excessive alloying of Al and Si or addition of rare elements such as Nb, Mo, W, and rare earths. To provide the oxidation resistance and high-temperature strength, which are aimed at by the present invention, the lower limit is 0.01%. The upper limit is 1.0% from the standpoint of fabricability. However, in terms of economic efficiency as compared to SUH21, the Sn content is preferably 0.1 to 0.6%. In view of performance and alloy cost, it is more preferably 0.2 to 0.5%.

Nb and Ti are elements that improve oxidation resistance by the effect of stabilizing elements to fix C and N, and are added as required. Their amount, when added, is 0.03% or more, in which case the effect of each element is exerted. However, excessive addition leads to increase in alloy cost and reduction in fabricability associated with increased recrystallization temperature; thus, the upper limit of each element is 0.5%. In view of effectiveness, alloy cost, and fabricability, a preferred range of one or two of Nb and Ti is 0.05 to 0.5%. A more preferred range is 0.1 to 0.3%.

Ni, Cu, Mo, V, Zr, and Co are elements that are effective for the increase in high-temperature strength by synergistic effects with Sn, and added as required. The amount of Ni, Cu, and Mo, when added, is 0.15% or more, in which case the effect of each element is exerted. The amount of V, Zr, and Co, when added, is 0.01% or more, in which case the effect of each element is exerted. However, excessive addition leads to increase in alloy cost and reduction in fabricability; thus, the upper limit of each element is 0.5%.

Mg forms Mg oxide together with Al in molten steel to act as a deoxidizer, and, in addition, acts as crystallization nuclei of TiN. TiN forms solidification nuclei of ferrite phase in a solidification process and promotes crystallization of TiN, thereby forming fine ferrite phase at the solidification. By forming a fine solidified structure, surface defects due to a coarse solidified structure, such as ridging and roping of products, can be prevented, and, besides, the workability improves; therefore, Mg is added as required. The amount of Mg, when added, is 0.0001%, in which case such effects are exerted. However, when it is more than 0.005%, fabricability deteriorates; thus, the upper limit is 0.005%. Preferably, in view of fabricability, the Mg content is 0.0003 to 0.002%.

B is an element that improves hot workability and secondary workability, and addition thereof to a high-purity ferritic stainless steel is effective. The amount of B, when added, is 0.0003% or more, in which case such an effect is exerted. However, excessive addition causes reduction in elongation; thus, the upper limit is 0.005%. Preferably, in view of material cost and workability, the B content is 0.0005 to 0.002%.

Ca is an element that improves hot workability and steel cleanliness and added as required. The amount of Ca, when added, is 0.0003% or more, in which case such an effect is exerted. However, excessive addition leads to reduction in fabricability and reduction in oxidation resistance due to water-soluble inclusions such as CaS; thus, the upper limit is 0.005%. Preferably, in view of fabricability and oxidation resistance, the Ca content is 0.0003 to 0.0015%.

Zr, La, Y, Hf, and REM may be added as required because they have effects of improving hot workability and steel cleanliness and significantly improving oxidation resistance and hot workability. Their amount, when added, is 0.001% or more, in which case the effect of each element is exerted. However, excessive addition leads to increase in alloy cost and reduction in fabricability; thus, the upper limit of each element is 0.1%. Preferably, in view of effectiveness, economic efficiency, and fabricability, the content of one or more of them is each 0.001 to 0.05%.

(II) Limitations on the preferred process for producing a steel sheet will now be described.

Mentioned below is a production process that is preferred for achieving the oxidation resistance and high-temperature strength equal to or higher than those of SUH21, provided that the components described in Section (I) above are contained.

The steel sheet of the present invention is obtained by ingot-casting a steel having the component composition of (I) by a conventional method using a converter, electric furnace, or further secondary refiner, forming a slab (cast billet, steel billet) by the continuous casting process or steel ingot process, heating the slab in a heating furnace, hot-rolling the heated slab, and winding the hot-rolled steel sheet into a coil, alternatively, if necessary, annealing the hot-rolled sheet, and then further carrying out cold rolling, annealing, and pickling to form a cold-rolled steel sheet.

In hot rolling, the extraction temperature after heating a cast billet (slab) is set at 1100° C. or higher in order to ensure the amount of scale deposition for removing inclusions which induce a scab from the cast billet surface. The amount of scale deposition is 0.1 mm or more in scale thickness. The upper limit of the extraction temperature is set at 1250° C. in order to inhibit the generation of MnS and CaS, which can be the origin of unusual oxidation, to thereby stabilize TICS. In view of the oxidation resistance aimed at by the present invention, the extraction temperature is preferably set at 1100 to 1200° C.

The winding temperature after hot rolling is set at 600° C. or lower in order to ensure steel toughness and prevent internal oxide and grain boundary oxidation which can cause degradation of surface properties. When the winding temperature is higher than 600° C., precipitates containing Ti and P are likely to precipitate, which can lead to reduction in oxidation resistance. When the winding temperature is lower than 400° C., malformation of a hot-rolled steel tape can occur when water is poured after hot rolling, inducing a surface flaw at the time of coil unwinding or threading. In view of the oxidation resistance aimed at by the present invention, the winding temperature is preferably set at 500 to 600° C.

After hot rolling, a single cold rolling or a plurality of cold rolling with intervening process annealing may be carried out omitting the hot-rolled sheet annealing. However, it is preferable to carry out hot-rolled sheet annealing at 900° C. or higher in order to increase high-temperature strength, which is aimed at by the present invention, by solid-solution strengthening of Nb and Ti, or Ni, Cu, and Mo, in addition to Sn and Cr. The upper limit of the temperature of the hot-rolled sheet annealing is preferably 1050° C. in view of reduction in surface properties and descaling-by-pickling property.

Setting the rate of cooling the hot-rolled sheet at 10° C./sec or less over a temperature range of 550 to 850° C. is effective for improvement in high-temperature strength and oxidation resistance because grain boundary segregation of Sn and Cr is reduced to form a uniform solid solution and production of fine carbonitrides is promoted. The cooling rate is preferably 5° C./sec or less in order to promote fine precipitation. The lower limit is, but not restricted to, 0.01° C./sec in order to reduce large carbonitride.

Cold rolling conditions are not particularly restricted. Final annealing after cold rolling is preferably carried out at 1000° C. or lower in view of surface properties. The lower limit is preferably 800° C. where, in the case of the steel sheet of the present invention, recrystallization is completed. The pickling method is not particularly restricted, and pickling is performed using a method commonly used in industry. Examples thereof include immersion in alkali salt bath electrolytic picking+immersion in nitric hydrofluoric acid, wherein in the electrolytic picking, neutral salt electrolysis, nitric acid electrolysis, or the like is performed.

EXAMPLES

Examples of the present invention will now be described.

A ferritic stainless steel including the components in Table 1 was ingot-cast, hot-rolled at a temperature of extraction from a heating furnace of 1180 to 1250° C., and wound at a temperature of 500 to 730° C. to form a hot-rolled steel sheet with a thickness of 3.0 to 6.0 mm. The hot-rolled steel sheet was annealed, and a single cold rolling or double cold rolling with intervening process annealing was carried out to produce a cold-rolled steel sheet with a thickness of 1.0 to 2.0 mm. The cold-rolled steel sheets obtained were all subjected to final annealing at a temperature of 850 to 1050° C. where recrystallization is completed.

The steel components that are within the range defined in the present invention (components of the present invention) and that are without the range (comparative components) were used. For the production conditions, preferred conditions defined in the present invention (examples of the present invention) and other conditions (comparative examples) were used. Further, as a comparative steel, SUS430J1L (19% Cr-0.5% Nb), SUS436J1L (18Cr-1Mo), and SUS21 (18% Cr-3% Al) were used.

Example 1

Various test pieces were collected from the steel sheets obtained, and Steels A to Q, SUS430J1L, and SUS436JL shown in Table 1 were tested as described below. The properties of the steel sheets were examined and evaluated.

High-temperature strengths (TS, 0.2% PS) were determined by high-temperature tensile test using tensile test pieces with a parallel length of 40 mm and a width of 12.5 mm collected in the rolling direction. The high-temperature tensile test was carried out at 800° C. The tensile speed was 0.09 mm/min until 0.2% proof stress was reached and 3 mm/min after that.

Oxidation resistances were evaluated by a continuous oxidation test in air at 980° C. for 200 hr using test pieces of 20 mm×25 mm collected and subjected to wet #600 polish finishing on both surfaces and end faces. The results are shown in Table 2. The occurrence of (i) peel-off and (ii) unusual oxidation of a surface film was used as an evaluation index. (i) peel-off of a surface film was judged to have occurred when a change in hue that occurred as spots was observed, and (ii) unusual oxidation was judged to have occurred when a protective film on the surface was ruptured and a nodular oxidized shape mainly composed of Fe oxide was observed.

In SUS430J1L and SUS436JL used as a comparative steel in the continuous oxidation test conditions in air at 980° C. for 200 hr, peel-off of a surface film was observed, and unusual oxidation was observed at some parts. Accordingly, the object of the present invention is a steel sheet having both such oxidation resistance that unusual oxidation does not occur in the continuous oxidation test at 980° C. for 200 hr and a high-temperature strength equal to or higher than that of the comparative steel (0.2% PS at 800° C.≥35 MPa, T.S≥55 MPa).

TABLE 1

| | Steel Components of Samples (mass %) | | | | | | | | | | | |
|---|---|---|---|---|---|---|---|---|---|---|---|---|
| | C | Si | Mn | P | S | Cr | N | Al | Sn | Nb | Ti | Others |
| A | 0.004 | 0.06 | 0.08 | 0.021 | 0.0005 | 16.6 | 0.010 | 0.065 | 0.32 | — | — | |
| B | 0.004 | 0.07 | 0.07 | 0.021 | 0.0006 | 16.6 | 0.011 | 0.055 | 0.31 | 0.12 | 0.08 | B: 7 ppm |
| C | 0.004 | 0.20 | 0.08 | 0.022 | 0.0005 | 16.5 | 0.009 | 0.066 | 0.29 | — | 0.12 | |
| D | 0.004 | 0.11 | 0.08 | 0.022 | 0.0005 | 16.7 | 0.009 | 0.066 | 0.33 | 0.15 | 0.05 | Ni: 0.25 |
| E | 0.003 | 0.09 | 0.08 | 0.022 | 0.0005 | 16.7 | 0.009 | 0.075 | 0.33 | 0.16 | 0.07 | Ni, Cu, Mo: 0.2 |
| F | 0.027 | 0.50 | 0.08 | 0.021 | 0.0005 | 16.8 | 0.010 | 0.155 | 0.32 | 0.18 | 0.15 | Ni: 0.2, B: 5 ppm, Zr: 0.02 |
| G | 0.003 | 0.12 | 1.20 | 0.021 | 0.0005 | 18.8 | 0.010 | 0.075 | 0.25 | — | — | La, Y: 0.1, REM: 0.05 |
| H | 0.005 | 0.06 | 0.08 | 0.021 | 0.0005 | 23.5 | 0.010 | 0.065 | 0.20 | 0.25 | — | |
| I | 0.006 | 0.08 | 0.08 | 0.021 | 0.0005 | 16.4 | 0.026 | 0.455 | 0.32 | 0.17 | 0.18 | V: 0.2, Zr: 0.05 |
| J | 0.003 | 0.12 | 0.08 | 0.021 | 0.0005 | 19.4 | 0.009 | 0.068 | 0.08 | 0.05 | 0.06 | B, Mg: 7 ppm |
| K | 0.027 | 0.15 | 0.08 | 0.021 | 0.0005 | 16.2 | 0.010 | 0.065 | 0.57 | 0.07 | 0.06 | Zr, Co: 0.05, Ca: 7 ppm |
| 2A | 0.005 | 0.05 | 0.11 | 0.018 | 0.0005 | 17.2 | 0.010 | 1.1 | 0.31 | — | — | |
| 2B | 0.005 | 0.02 | 0.12 | 0.019 | 0.0006 | 16.8 | 0.011 | 1.5 | 0.25 | 0.15 | 0.11 | Ca: 7 ppm |
| 2C | 0.004 | 0.90 | 0.08 | 0.022 | 0.0005 | 17.5 | 0.009 | 0.9 | 0.31 | — | 0.15 | |
| 2D | 0.004 | 0.20 | 0.08 | 0.022 | 0.0005 | 17.2 | 0.009 | 1.1 | 0.33 | 0.15 | 0.05 | Ni: 0.25, Y: 0.02 |
| 2E | 0.027 | 0.50 | 0.08 | 0.021 | 0.0005 | 16.8 | 0.010 | 1.2 | 0.32 | 0.18 | 0.15 | |
| 2F | 0.003 | 0.15 | 1.20 | 0.021 | 0.0005 | 18.8 | 0.010 | 1.3 | 0.31 | — | — | La, Hf, REM: 0.03 |
| 2G | 0.005 | 0.09 | 0.08 | 0.021 | 0.0005 | 23.5 | 0.010 | 1.1 | 0.25 | 0.19 | 0.09 | Co: 0.01 |
| 2H | 0.006 | 0.03 | 0.08 | 0.021 | 0.0005 | 16.6 | 0.026 | 2.6 | 0.32 | 0.17 | 0.18 | V, Zr: 0.05 |
| 2I | 0.003 | 0.15 | 0.08 | 0.021 | 0.0005 | 19.4 | 0.009 | 1.2 | 0.08 | 0.05 | 0.06 | B, Mg: 7 ppm |
| 2J | 0.007 | 0.17 | 0.08 | 0.021 | 0.0005 | 17.2 | 0.010 | 0.9 | 0.57 | 0.07 | 0.06 | |
| 2K | 0.021 | 0.35 | 0.28 | 0.032 | 0.0018 | 18.6 | 0.022 | 2.3 | 0.21 | 0.13 | 0.11 | |
| L | 0.035 | 0.09 | 0.08 | 0.022 | 0.0006 | 16.3 | 0.015 | 0.075 | 0.25 | 0.19 | 0.09 | |
| M | 0.003 | 0.20 | 1.70 | 0.023 | 0.0015 | 17.2 | 0.011 | 0.085 | 0.11 | 0.11 | 0.11 | |
| N | 0.005 | 0.08 | 0.09 | 0.022 | 0.0011 | 15.7 | 0.012 | 0.075 | 0.22 | — | 0.15 | |
| O | 0.003 | 0.18 | 0.11 | 0.023 | 0.0009 | 16.3 | 0.033 | 0.085 | 0.24 | — | 0.22 | |
| P | 0.005 | 0.15 | 0.11 | 0.021 | 0.0006 | 16.4 | 0.011 | 0.042 | 0.21 | — | 0.21 | |
| Q | 0.005 | 0.13 | 0.12 | 0.022 | 0.0011 | 16.6 | 0.013 | 0.065 | 0.008 | 0.15 | 0.05 | |
| SUS430J1L | 0.006 | 0.20 | 0.30 | 0.023 | 0.0012 | 19.5 | 0.015 | 0.035 | — | 0.55 | — | |
| SUS436J1L | 0.004 | 0.20 | 0.12 | 0.021 | 0.0009 | 17.8 | 0.011 | 0.060 | — | — | 0.20 | Mo: 1.1 |
| 2L | 0.035 | 0.13 | 0.08 | 0.022 | 0.0006 | 16.3 | 0.015 | 1.1 | 0.25 | 0.19 | 0.09 | |
| 2M | 0.003 | 0.20 | 1.70 | 0.023 | 0.0015 | 17.2 | 0.011 | 1.1 | 0.25 | 0.11 | 0.11 | |
| 2N | 0.005 | 0.18 | 0.09 | 0.022 | 0.0011 | 15.5 | 0.012 | 1.1 | 0.32 | — | 0.15 | |
| 2O | 0.003 | 0.28 | 0.11 | 0.023 | 0.0009 | 16.8 | 0.033 | 1.1 | 0.24 | — | 0.22 | |
| 2P | 0.005 | 0.15 | 0.12 | 0.022 | 0.0011 | 16.7 | 0.013 | 1.1 | 0.008 | 0.15 | 0.05 | |
| SUH21 | 0.008 | 0.21 | 0.11 | 0.033 | 0.0008 | 18.2 | 0.015 | 3.1 | — | — | 0.15 | |

Note:

Underlines denote outside the scope of the present invention.

—: No addition.

TABLE 2

Production Conditions and Relationship between Oxidation Resistance and High-Temperature Strength

| | | | High-Temperature Strength at 800° C. (MPa) | | Oxidation at 980° C. for 200 hr | | Hot Rolling (° C.) | | Hot-Rolled Sheet Annealing | | |
|---|---|---|---|---|---|---|---|---|---|---|---|
| | No | Steel | 0.2% PS | TS | Peel-Off | Unusual Oxidation | Extraction | Winding | Temperature (° C.) | Cooling Rate (° C./sec) | Remarks |
| Components of the Present Invention | 1 | A | 40 | 70 | Not Observed | Not Observed | 1180 | 550 | 880 | 5 | Example of the Present Invention |
| | 2 | | 35 | 65 | Observed | Not Observed | 1180 | 700* | 880 | 13* | Example of the Present Invention |
| | 3 | | 35 | 65 | Observed | Not Observed | 1180 | 520 | 870 | 15* | Example of the Present Invention |
| | 4 | | 35 | 65 | Observed | Not Observed | 1180 | 700* | 870 | 5 | Example of the Present Invention |
| | 5 | B | 45 | 70 | Not Observed | Not Observed | 1190 | 530 | 980 | 5 | Example of the Present Invention |
| | 6 | | 35 | 65 | Observed | Not Observed | 1160 | 720* | 990 | 15* | Example of the Present Invention |
| | 7 | C | 35 | 65 | Not Observed | Not Observed | 1160 | 550 | 890 | 10 | Example of the Present Invention |
| | 8 | D | 45 | 75 | Not Observed | Not Observed | 1160 | 520 | 990 | 8 | Example of the Present Invention |
| | 9 | E | 50 | 80 | Observed | Not Observed | 1180 | 550 | 1000 | 15* | Example of the Present Invention |
| | 10 | F | 40 | 70 | Observed | Not Observed | 1180 | 720* | 1020 | 3 | Example of the Present Invention |
| | 11 | G | 45 | 80 | Not Observed | Not Observed | 1210 | 580 | 1010 | 5 | Example of the Present Invention |
| | 12 | H | 50 | 85 | Not Observed | Not Observed | 1240 | 570 | 1020 | 10 | Example of the Present Invention |
| | 13 | I | 40 | 65 | Observed | Not Observed | 1120 | 500 | 970 | 8 | Example of the Present Invention |
| | 14 | J | 40 | 70 | Not Observed | Not Observed | 1210 | 540 | 1020 | 10 | Example of the Present Invention |
| | 15 | K | 35 | 65 | Not Observed | Not Observed | 1180 | 520 | 980 | 5 | Example of the Present Invention |
| Comparative Components | 16 | L | 35 | 70 | Observed | Observed | 1180 | 520 | 980 | 5 | Comparative Example |
| | 17 | M | 25* | 50* | Observed | Observed | 1190 | 530 | 980 | 5 | Comparative Example |
| | 18 | N | 35 | 70 | Observed | Observed | 1190 | 530 | 990 | 5 | Comparative Example |
| | 19 | O | 35 | 70 | Observed | Observed | 1180 | 520 | 980 | 5 | Comparative Example |
| | 20 | P | 35 | 70 | Observed | Observed | 1190 | 530 | 980 | 5 | Comparative Example |
| | 21 | Q | 35 | 70 | Observed | Observed | 1180 | 520 | 990 | 5 | Comparative Example |
| | 22 | 430J1L | 35 | 55 | Observed | Observed | — | — | — | — | Reference Example |
| | 23 | 436J1L | 35 | 50 | Observed | Observed | — | — | — | — | Reference Example |

Notes:
Asterisk indicates that the Example varies from the preferred production process of the present invention.

Table 2 shows that Test No. 1, 5, 7, 8, and 11 to 15 are a high-purity ferritic stainless steel that satisfy both of the components defined in the present invention and the preferred production process (hot-rolling conditions, hot-rolled sheet annealing conditions). These steel sheets are provided with a high-temperature strength and oxidation resistance higher than those of SUS430J1L and 436J1L.

Test No. 2, 3, 4, 6, 9, and 10 have the components defined in the present invention and vary partially and totally from the preferred production process of the present invention (hot-rolling conditions, hot-rolled sheet annealing conditions). These steel sheets, however, are provided with a high-temperature strength and oxidation resistance equal to those of SUS430J1 and SUS436J1L, which are aimed at by the present invention. Further, Test No. 13 contains a large N content compared to the steels of other inventive examples, and, although varying from the high purification suitable in the present invention, has composition within the scope of the present invention, which is the case of having the properties aimed at by the present invention.

Test No. 16 to 21 implement the preferred production process of the present invention (hot-rolling conditions, hot-rolled sheet annealing conditions), but vary from the components of the present invention. These steel sheets are not provided with the high-temperature strength and oxidation resistance aimed at by the present invention.

Example 2

Various test pieces were collected from the steel sheets obtained in the same manner as in Example 1, and Steels 2A to 2Q and SUS21 (18% Cr-3% Al) were tested in the same manner as in Example 1. The properties of the steel sheets were examined and evaluated.

However, oxidation resistances were evaluated by a continuous oxidation test under harsher conditions in air at 1050° C. for 200 hr. The results are shown in Table 3. The occurrence of (i) peel-off and (ii) unusual oxidation of a surface film was used as an evaluation index, similarly to Example 1. (i) peel-off of a surface film was judged to have occurred when a change in hue that occurred as spots was observed, and (ii) unusual oxidation was judged to have occurred when a protective film on the surface was ruptured and a nodular oxidized shape mainly composed of Fe oxide was observed.

In SUH21 (18Cr-3Al) used as a comparative steel, if not unusual oxidation, change in hue and peel-off associated therewith of a surface film was partially observed. Accordingly, the object of the present invention is a steel sheet having both such oxidation resistance that unusual oxidation does not occur in the continuous oxidation test in air at 1050° C. for 200 hr and a high-temperature strength equal to or higher than that of the comparative steel (0.2% P.S at 800° C.≥45 MPa, T.S≥60 MPa).

TABLE 3

Production Conditions and Relationship between Oxidation Resistance and High-Temperature Strength

| | | | High-Temperature Strength at 800° C. (MPa) | | Oxidation at 1050° C. for 200 hr | | Hot Rolling (° C.) | | Hot-Rolled Sheet Annealing | | |
|---|---|---|---|---|---|---|---|---|---|---|---|
| | No | Steel | 0.2% PS | TS | Peel-Off | Unusual Oxidation | Extraction | Winding | Temperature (° C.) | Cooling Rate (° C./sec) | Remarks |
| Components of the Present Invention | 21 | 2A | 40 | 70 | Not Observed | Not Observed | 1210 | 540 | 890 | 5 | Example of the Present Invention |
| | 22 | | 35* | 55* | Observed | Not Observed | 1230 | 700* | 880 | 15* | Example of the Present Invention |
| | 23 | 2B | 45 | 80 | Not Observed | Not Observed | 1230 | 550 | 990 | 5 | Example of the Present Invention |
| | 24 | | 40 | 70 | Observed | Not Observed | 1210 | 730* | 970 | 15 | Example of the Present Invention |
| | 25 | 2C | 50 | 70 | Not Observed | Not Observed | 1210 | 560 | 890 | 10 | Example of the Present Invention |
| | 26 | 2D | 50 | 80 | Not Observed | Not Observed | 1230 | 550 | 1000 | 8 | Example of the Present Invention |
| | 27 | 2E | 50 | 85 | Observed | Not Observed | 1210 | 580 | 980 | 15* | Example of the Present Invention |
| | 28 | | 50 | 85 | Observed | Not Observed | 1210 | 580 | 980 | 5 | Example of the Present Invention |
| | 29 | 2F | 55 | 90 | Not Observed | Not Observed | 1230 | 520 | 1020 | 5 | Example of the Present Invention |
| | 30 | 2G | 55 | 90 | Not Observed | Not Observed | 1240 | 580 | 1010 | 5 | Example of the Present Invention |
| | 31 | 2H | 50 | 85 | Not Observed | Not Observed | 1240 | 570 | 1020 | 10 | Example of the Present Invention |
| | 32 | 2I | 50 | 85 | Not Observed | Not Observed | 1230 | 500 | 970 | 8 | Example of the Present Invention |
| | 33 | 2J | 55 | 100 | Not Observed | Not Observed | 1210 | 540 | 1020 | 10 | Example of the Present Invention |
| | 34 | 2K | 60 | 95 | Observed | Not Observed | 1210 | 550 | 990 | 5 | Example of the Present Invention |
| Comparative Components | 35 | 2L | 45 | 75 | Observed | Observed | 1180 | 520 | 980 | 5 | Comparative Example |
| | 36 | 2M | 40 | 75 | Observed | Observed | 1190 | 530 | 980 | 5 | Comparative Example |
| | 37 | 2N | 45 | 75 | Observed | Observed | 1190 | 530 | 990 | 5 | Comparative Example |
| | 38 | 2O | 45 | 75 | Observed | Observed | 1180 | 520 | 980 | 5 | Comparative Example |
| | 39 | 2P | 35* | 55* | Observed | Observed | 1190 | 530 | 980 | 5 | Comparative Example |
| | 40 | 2Q | 40 | 65 | Observed | Observed | 1190 | 520 | 980 | 5 | Comparative Example |
| | 41 | SUS21 | 40 | 60 | Observed | Not Observed | — | — | — | — | Reference Example |

Notes:

Asterisk indicates that the Example varies from the preferred production process of the present invention.

Table 3 shows that Test No. 21, 23, 25, 26, and 29 to 33 are a high-purity ferritic stainless steel that satisfy both of the components defined in the present invention and the preferred production process (hot-rolling conditions, hot-rolled sheet annealing conditions). These steel sheets had an alumina film and exhibited an oxidation resistance equal to or higher than that of the comparative steel SUS21, and achieved the high-temperature strength at the same time.

Test No. 22, 24, and 27 have the components defined in the present invention and vary partially and totally from the preferred production process of the present invention (hot-rolling conditions, hot-rolled sheet annealing conditions). These steel sheets, however, are provided with a high-temperature strength and oxidation resistance equal to those of SUS21, which are aimed at by the present invention. Further, Test No. 28, 31, and 34 contain a large N content compared to the steel of other inventive examples, and, although varying from the high purification suitable in the present invention, have composition within the scope of the present invention, which is the case of having the properties aimed at by the present invention. Test No. 11 and 14 are provided with the high-temperature strength and oxidation resistance aimed at by the present invention, but they have an Al content of more than 2% and are slightly poor in weldability and toughness among the examples of the present invention.

Test No. 35 to 40 implement the preferred production process of the present invention (hot-rolling conditions, hot-rolled sheet annealing conditions), but vary from the components of the present invention. These steel sheets are not provided with the high-temperature strength and oxidation resistance aimed at by the present invention.

Figure 2:
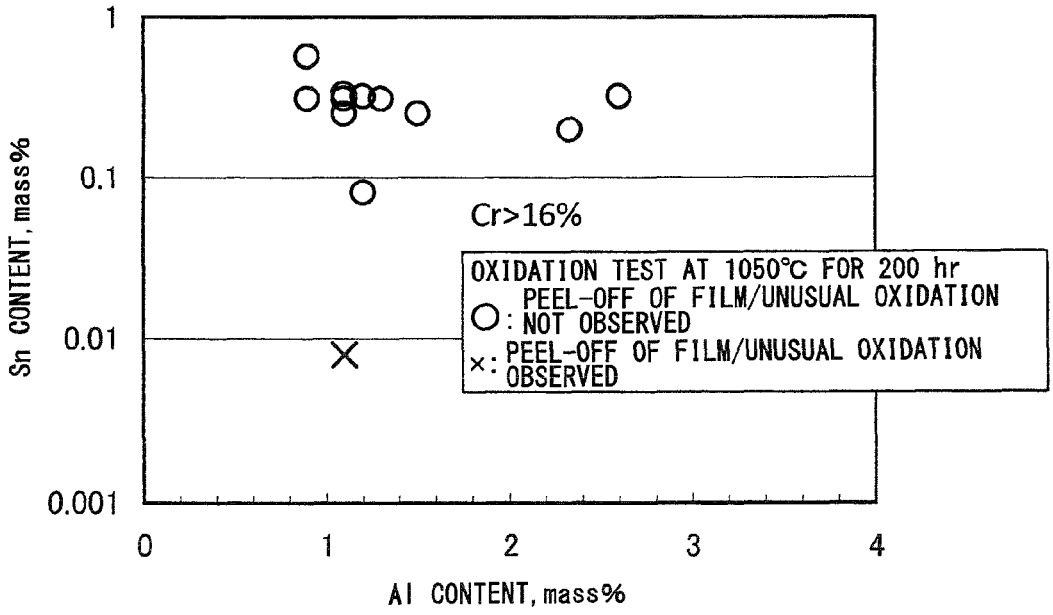
FIG. 2 illustrates the relationship between the contents of Cr, Sn, and Al and oxidation resistance of the stainless steel sheet of Example 2.

FIG. 1 illustrates the relationship between the contents of Cr, Sn, and Al of the steel of Example 1 shown in Table 1 and the oxidation resistance shown in Table 2. Similarly, FIG. 2 illustrates the relationship between the contents of Cr, Sn, and Al of the steel of Example 2 shown in Table 1 and the oxidation resistance shown in Table 3. The steels provided with the oxidation resistance aimed at by the present invention are denoted by "○", and the steels whose oxidation resistance was evaluated to be equal to or lower than that of comparative steels by "x". The results shows that for obtaining good oxidation resistance as well as high-temperature strength by adding Sn, it is important to adjust to be in the component range defined in the present invention (Cr, Sn, Al).

INDUSTRIAL APPLICABILITY

According to the present invention, a low-alloy high-purity ferritic stainless steel sheet provided with improved oxidation resistance and high-temperature strength equal to or higher than those of existing heat-resistant steels by utilizing Sn addition in trace amounts can be obtained without relying on excessive alloying of Al and Si which reduces fabricability and weldability or addition of rare elements such as Nb, Mo, W, and rare earths.

The invention claimed is:

1. A ferritic stainless steel sheet, consisting of, in % by mass, C: 0.001 to 0.03%, Si: 0.01 to 2%, Mn: 0.01 to 1.5%, P: 0.032% or less, S: 0.0001 to 0.01%, Cr: 16 to 30%, N: 0.001 to 0.03%, Al: 0.155 to 3%, and Sn: 0.01 to 1%, with the remainder being Fe and unavoidable impurities, and having a 0.2% proof stress of 35 MPa or more and a tensile strength of 65 Mpa or more at 800° C., and wherein the ferritic stainless steel sheet has oxidation resistance which does not cause unusual oxidation in a continuous oxidation test at 980° C. for 200 hr.

2. A ferritic stainless steel sheet, consisting of, in % by mass, C: 0.001 to 0.03%, Si: 0.01 to 2%, Mn: 0.01 to 1.5%, P: 0.032% or less, S: 0.0001 to 0.01%, Cr: 16 to 30%, N: 0.001 to 0.03%, Al: 0.055 to 3%, and Sn: 0.01 to 1%, and one or more of Nb: 0.18% or less, Ti: 0.5% or less, Ni: 0.5% or less, Cu: 0.5% or less, Mo: 0.5% or less, V: 0.5% or less, Zr: 0.5% or less, Co: 0.5% or less, Mg: 0.005% or less, B: 0.005% or less, Ca: 0.005% or less, La: 0.1% or less, Y: 0.1% or less, Hf: 0.1% or less, and REM: 0.1% or less, with the remainder being Fe and unavoidable impurities, and having a 0.2% proof stress of 35 MPa or more and a tensile strength of 65 Mpa or more at 800° C., and wherein the ferritic stainless steel sheet has oxidation resistance which does not cause unusual oxidation in a continuous oxidation test at 980° C. for 200 hr.

3. A process for producing a ferritic stainless steel sheet, comprising heating a stainless steel slab having the steel components according to claim 1 or 2, wherein an extraction temperature is 1100 to 1250° C., and a winding temperature after hot rolling is 600° C. or lower.

4. The process for producing the ferritic stainless steel sheet according to claim 3, comprising annealing the steel sheet at 900 to 1050° C., and then cooling the annealed steel sheet at 5° C./sec or less over a temperature range of 550 to 850° C.

5. The ferritic stainless steel sheet according to claim 1 or 2, wherein the C content in the steel sheet is 0.004 to 0.007%.

6. The ferritic stainless steel sheet according to claim 5, wherein the Al content in the steel sheet is more than 0.8% to 3%.

7. A process for producing a ferritic stainless steel sheet, including heating a stainless steel slab having the steel components according to claim 5, wherein an extraction temperature is 1100 to 1250° C., and a winding temperature after hot rolling is 600° C. or lower.

8. The process for producing the ferritic stainless steel sheet according to claim 7, including annealing the steel sheet at 900 to 1050° C., and then cooling the annealed steel sheet at 5° C./sec or less over a temperature range of 550 to 850° C.

9. The ferritic stainless steel sheet according to claim 1 or 2, wherein the Al content in the steel sheet is 0.155 to 1.3%.

10. A process for producing a ferritic stainless steel sheet, including heating a stainless steel slab having the steel components according to claim 9, wherein an extraction temperature is 1100 to 1250° C., and a winding temperature after hot rolling is 600° C. or lower.

11. The process for producing the ferritic stainless steel sheet according to claim 10, including annealing the steel sheet at 900 to 1050° C., and then cooling the annealed steel sheet at 5° C./sec or less over a temperature range of 550 to 850° C.

12. The ferritic stainless steel sheet according to claim 1 or 2, wherein the Al content in the steel sheet is more than 0.8% to 3%.

* * * * *